US005798200A

United States Patent [19]

Matsuura et al.

[11] Patent Number: 5,798,200

[45] Date of Patent: Aug. 25, 1998

[54] ELECTROPHOTOGRAPHIC IMAGE FORMING METHOD

[75] Inventors: Katsumi Matsuura; Shigeki Takenouchi, both of Hachioji, Japan

[73] Assignee: Konica Corporation, Japan

[21] Appl. No.: 802,609

[22] Filed: Feb. 19, 1997

[30] Foreign Application Priority Data

Feb. 21, 1996 [JP] Japan ..... 8-033584

[51] Int. Cl.[6] ..... G03G 13/16

[52] U.S. Cl. ..... 430/126; 430/98

[58] Field of Search ..... 430/110, 126, 430/98

[56] References Cited

U.S. PATENT DOCUMENTS 5,504,559 4/1996 Ojima et al. ..... 430/67

5,612,159 3/1997 Sato et al. ..... 430/110

*Primary Examiner*—John Goodrow

*Attorney, Agent, or Firm*—Jordan B. Bierman; Bierman, Muserlian and Lucas

[57] ABSTRACT

A method for forming plural images by repeating a process is disclosed. The method comprises the steps of (1) forming an electrostatic latent image on an organic photoreceptor, (2) developing the electrostatic latent image formed on the organic photoreceptor with a toner particles each of which contains domains of releasing agent having a number average domain diameter of 0.1 μm to 1.1 μm to form a toner image, (3) transferring the toner image to a image receiving paper using a transferring roller being pressed to the photoreceptor with a pressure of 25 g/cm$^2$ to 1000 g/cm$^2$, (4) separating the image receiving paper carrying the transferred toner image from the photoreceptor, (5) fixing the toner image carried on the image receiving paper, and (6) cleaning the surface of the photoreceptor.

11 Claims, 2 Drawing Sheets

ELECTROPHOTOGRAPHIC IMAGE FORMING METHOD

FIELD OF THE INVENTION

The present invention relates to an image forming method by electrophotographic process using an organic photoreceptor.

BACKGROUND OF THE INVENTION

Recently, an organic photoreceptor is become the main stream of the electrophotographic photoreceptor in stead of inorganic photoreceptors such as selenium type photoreceptors and amorphous silicon photoreceptors since the organic photoreceptor has much merits such as a wide selectivity of material, excellent environmental adaptation and low production cost.

In an image forming method according to Carlson process, a toner image is formed on an electrophotographic photoreceptor and the toner image is transferred onto an image receiving paper. The toner image transferred on the image receiving paper is fixed to form a final image. Accordingly, the quality of the final image is varied depending on the quality of the transferring means even if the quality of the toner image formed on the photoreceptor is very high.

As the transferring means, a transferring device making use of corona discharge has been usually used, since such the device is simple and compact in the structure and light in the weight thereof.

However, the corona discharge transferring means causes problems that handling thereof is dangerous and difficult, and that the means generates an active gas such as ozone and NO which causes fatigue and deterioration of the photoreceptor, because the transferring means uses corona discharge irradiated from a discharging wire to the photoreceptor through a space. To the discharging wire, a high voltage, for example 5 to 10 kV, is applied.

The toner image transferring efficiency of the above-mentioned transferring means is insufficient, particularly, in a case of plural color toner images are formed in layers one upon another on the photoreceptor and the toner images is collectively transferred to the image receiving paper, and unbalance in colors in the image is caused by difference of the transfer efficiency of the toner image positioned at upper layer and that of the toner image positioned at lower layer. Further, the toner transfer efficiency of the transferring means tends to be varied by changing the surrounding condition since the corona discharge is varied depending on the surrounding condition.

As a device for replacing the corona discharge transferring means, for example, a roller transferring device is proposed in Japanese Patent Publication Open to Public Inspection No. 7-98548/1995, which comprises a transferring roller for transferring a toner image formed on a photoreceptor to an image receiving paper and a power supply for supplying a transferring potential to the transferring roller.

The above-mentioned publication describes that the generation of active gas in the corona discharge transferring means can be prevented and the electrical power consumption can be reduced by this method, and an image with a high resolving power can be obtained without deformation of the toner image since the image receiving paper is contacted to the photoreceptor with a pressure applying by the transferring roller.

However, in the transfer method using the transferring roller, a foreign substance tend to be adhered on the surface of the photoreceptor because the transferring roller is contacted always with a pressure to the photoreceptor. Particularly, a spot defect or line-shaped defect caused by adhesion of the foreign substance is easily formed when the image formation is carried out by the use of an organic photoreceptor which has a soft surface and a high surface energy.

Accordingly, further improvement is required to stably obtain images having a high quality without formation of image defects and degradation of the photoreceptor caused by fatigue when a lot of images is formed by repeating the image forming process using a combination of an organic photoreceptor and the roller transferring method.

SUMMARY OF THE INVENTION

The object of the invention is to provide a image forming method by which a clear image having a high resolving power and a high density can be stably obtained without formation of a spot-shape or line-shape defect in the course of repeated image formation.

The present invention has been attained by the find by the inventors that the adhesion of the foreign substance on the photoreceptor and formation of the image defect thereby relate to a releasing agent contained in the toner, particularly relates to the domain diameter of the releasing agent.

The object of the invention is attained by an electrophotographic image forming method for forming plural images by repeating a process comprising the steps of forming an electrostatic latent image on an organic photoreceptor, developing the electrostatic latent image formed on the organic photoreceptor with toner particles each of which contains domains of a releasing agent having a number average domain diameter of 0.1 μm to 1.1 μm to form a toner image, transferring the toner image to a image receiving paper by a transferring roller being pressed to the organic photoreceptor with a pressure of 25 g/cm$^2$ to 1000 g/cm$^2$, separating the image receiving paper carrying the transferred toner image from the photoreceptor, fixing the toner image carried on the image receiving paper, and cleaning the surface of the photoreceptor.

In the preferable embodiment of the invention, the outermost layer of the photoreceptor contains inorganic or organic particles having a volume average diameter of 0.05 μm to 2.0 μm, and has a ten point height of irregularities Rz of 0.05 μm to 1.0 μm, and the transferring roller comprises a porous foamed material.

DETAILED DESCRIPTION OF THE INVENTION

Constitution of photoreceptor

The organic photoreceptor usable in the invention includes a multi-layer photoreceptor comprising a carrier generating layer (CGL) containing a carrier generating material (CGM) and a carrier transporting layer (CTL)

containing a carrier transporting material (CTM) laminated on a substrate, a single layer photoreceptor having a layer in which a CGM and a CTM are contained as a mixture, and those further having a protective layer. Among them, a photoreceptor having plural CTLs on the CGL is preferred. In the invention, at least one of the above CGM and CTM is an organic compound and the outermost layer of the photoreceptor contains at least one of the above-mentioned organic compounds.

It is preferred in the invention that the outermost layer of the photoreceptor contains particles of an inorganic or organic substance, hereinafter referred to an inorganic particle and an organic particle, respectively, having a volume average diameter of 0.05 μm to 2.0 μm to strengthen the resistivity against mechanical abrasion of the surface of the photoreceptor.

Figure 1:
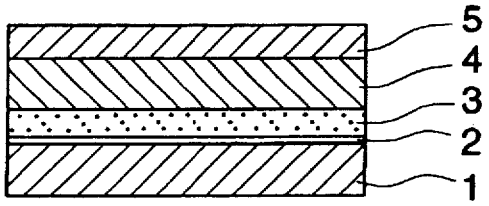
FIG. 1 shows the layer structure of a photoreceptor relating to the invention.

FIG. 1 is a schematic a cross-section showing the layer structure of a typical example of photoreceptor relating to the invention, which has plural carrier transporting layers laminated on a carrier generation layer. In FIG. 1, 1 is an electrical conductive substrate, 2 is an interlayer, 3 is CGL, 4 is first CTL and 5 is second CTL, hereinafter referred to CTTL. The inorganic or organic particles are contained in CTTL 5.

As the conductive substrate 1, a plate of metal such as aluminum, stainless steel or iron, a flexible support such as paper or plastic film on which a layer of metal such as aluminum, palladium or gold is provided by lamination or evaporation, and a flexible support such as paper and plastic film on which a layer containing electric conductive substance such as electric conductive polymer, indium oxide or tin oxide is provided by coating or evaporation are usable.

The interlayer 2, which is provided according to necessity, may be comprises casein, polyvinyl alcohol, nitrocellulose, ethylene-acrylic acid copolymer, polyvinyl butyral, phenol resin, polyamides such as Nylon 6, Nylon 66 and alkoxymethylated nylon, polyurethane, gelatin and aluminum oxide. The thickness of the interlayer is preferably 0.1 to 10 μm, more preferably 0.1 to 5 μm.

Although there is no limitation on the kind of CGM of the above CGL 3, for example, a phthalocyanine pigment, polycyclic quinone pigment, azo pigment, perylene pigment, indigo pigment, quinacridone pigment, azulenium pigment, squalilium dye, cyanine dye, pyrilium dye, thiopyrilium dye, triphenylmethane dye and styryl dye are usable. Such the CGM is made up a layer solely or in a form of dispersion in a resin. The resin usable in CGL includes a styrene-acryl resin, polycarbonate resin, polyester resin, acryl resin, polyvinyl chloride resin, polyvinylidene chloride resin, styrene resin, polyvinyl acetate resin, styrene-butadiene resin, vinylidene chloride-acrylonitrile resin, vinyl chloride-vinyl acetate resin, vinyl chloride-vinyl acetate-maleic anhydride resin, silicone resin, silicone alkyd resin, phenol-formaldehyde resin, polyvinyl acetal resin, and polyvinyl butyral resin.

The thickness of CGL 3 is preferably 0.01 to 10 μm.

The above mentioned CTM to be contained in CTL 4 and CTTL 5 includes, for example, oxazole derivatives, oxadiazole derivatives, thiazole derivatives, thiadiazole derivatives, triazole derivatives, imidazole derivatives, imidazolone derivatives, imidazoline derivatives, bis-imidazolidine derivatives, styryl compounds, hydrazone compounds, benzidine compounds, pyrazoline derivatives, stilbene derivatives, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazoles, poly-1-vynylpyrenes and poly-9-vinylanthrathenes, even though there is no limitation on the kind of CTM. These CTMs are used solely or in combination in a form of dispersed or dissolved in a resin. The resin to be used in this layer includes a styrene-acryl resin, polycarbonate resin, polyester resin, polyacryl resin, polyvinyl chloride resin, polyvinylidene chloride resin, styrene resin, polyvinyl acetate, styrene-butadiene resin, vinylidene chloride-acrylonitrile resin, vinyl chloride-vinyl acetate resin, vinyl chloride-vinyl acetate-maleic anhydride resin, silicone resin, silicone alkyd resin, phenol-formaldehyde resin, polyvinyl acetal resin and polyvinyl butyral resin.

The thickness of CTL 4 is usually 5 to 50 μm, preferably 10 to 40 μm, and that of CTTL 5 is usually 0.2 to 30 μm, preferably 0.4 to 20 μm. In CTTL 5, inorganic or organic particles having a volume average diameter of 0.05 μm to 2.0 μm are preferably contained.

As the material of the inorganic particle, for example, an oxide such as cerium oxide, chromium oxide, aluminum oxide, magnesium oxide, silicon oxide, tin oxide, zirconium oxide, iron oxide or titanium oxide; a sulfate such as calcium sulfate or barium sulfate, a silicate such as calcium silicate or magnesium silicate; a nitride such as boron nitride or titanium nitride; a carbide such as silicon carbide, titanium carbide, boron carbide, tungsten carbide or zirconium carbide; and a boride such as zirconium boride or titanium boride are usable. The material of the organic particles includes Teflon, polypropylene, cross-linked polystyrene, polyethylene, and cross-linked polymethyl methacrylate. The inorganic particles and organic particles may be used singly or in combination.

The inorganic or organic particles preferably have an volume average diameter of 0.05 to 2.0 μm. The particle preferably have a shape of substantial sphere having a length ratio of major axis to minor axis of less then 2.0.

When the volume average diameter of the inorganic or organic particles is within the range of 0.05 to 2.0 μm, the mechanical strength of the surface of photoreceptor is made sufficient, and abrasion of the photoreceptor surface in the course of repeatedly using can be inhibited. As the result, the electrophotographic properties of the photoreceptor can be maintained for a prolonged period of use. Further damage and abrasion of a cleaning blade for cleaning the photoreceptor surface can also be inhibited and the blurring of the image caused by insufficient cleaning can be prevented.

The volume average diameter of the inorganic or organic particles and that of the later-mentioned toner particles may be determined by a laser diffraction/scattering particle size measuring apparatus LA-700 manufactured by Horiba Seisakusyo. The inorganic or organic pareticles are contained in CTTL 5 in an amount of 0.01 to 50 parts, preferably 0.1 to 40 parts, per 100 parts by weight of the resin.

The inorganic particle is preferably silica particle, particularly one which has a small amount of hydrophilic group on the surface thereof and has a lowered hygroscopicity. For example, a hydrophobic silica particle treated with a hydrophobilizing agent such as a titanium coupling agent or a silane coupling agent is usable.

When the inorganic or organic particles are contained in the outermost layer of the photoreceptor, the roughness of photoreceptor surface is changed principaly depending on the diameter of the particles. In the invention, it is preferred to make the ten point height of irregularities Rz of the photoreceptor surface to 0.05 μm to 1.0 μm. The ten point hight of irregularities Rz is determined by the method according to Jananese Industrial Standard JIS B 0610. When the value of Rz is within the above range, the mechanical strength of the surface of photoreceptor is held sufficient and electrophotographic properties of the photoreceptor can be maintained for a prolonged period of use. Adhesion of the foreign substance and formation of the spot-shape or line-shape can be prevented. Further damage and abrasion of a cleaning blade for cleaning the photoreceptor surface can also be inhibited and degradation of the image quality caused by insufficient cleaning can be prevented.

In the invention, a sheet-shaped photoreceptor may be used even though the description of the photoreceptor is principally related to a drum-shaped photoreceptor.

Constitution of toner

The developer usable in the image forming method of the invention may be either a single-component developer mainly composed of magnetic toner particles or a two-component developer composed of magnetic carrier particles and non-magnetic toner particles. The developer to be used in the invention is characterized by the toner, particularly by the domain size of the releasing agent contained in the toner.

The toner comprises a binder resin and a colorant and another additive such as a charge controlling agent added according to necessity. The volume average diameter of the toner particles is usually 1 μm to 30 m, preferably 3 μm to 9 μm. When the volume average diameter of the toner is within this range, the deformation of the toner image formed on the photoreceptor caused by transferring of the image to the image receiving paper by the pressure of the transfer roller is made smallest and a high resolution of the image can be obtained. The cleaning ability of the toner image is also satisfactory. The charge polarity of the toner is decided in accordance with the method of development, and the polarity can be controlled by selection of the kind and amount of the charge controlling agent, a combination of the charge controlling agent and the binder, or addition of an external additive such as fine particles of silica.

As the binder of the toner, well known various kinds of resin may be used without any limitation. Examples of typical binder include a polyester resin and styrene-acryl type resin.

The releasing agent to be used in the invention is a compound having a low softening point which is effective to prevent an off-set phenomena at the time of thermally fixing the toner image. Preferable examples of the releasing agent include a polyolefin wax such as a low molecular polypropylene or low molecular polyethylene, a resin acid ester wax, a higher fatty acid wax, a higher alcohol wax, a paraffin wax and an acid amide wax.

The releasing agent is existed in the binder resin of toner particle in a shape of island which is referred to domain in the invention.

The softening point of the releasing agent measured by a ring and ball method according to JIS K2531 is preferably within the range of 100° to 160° C.

Among them a low molecular polyolefin having a number average molecular weight of 2,000 to 8,000, for example, a low molecular polypropylene and a low molecular polyethylene, is particularly preferred.

The adding amount of the releasing agent is preferably 1 to 10 parts per 100 parts by weight of the binder resin.

The number average of the domain diameter of the releasing agent is determined by the following procedure.

The toner particles are buried in a resin and sliced by a microtome to make a slice having a thickness of 0.2 μm. The sliced sample is photographed by an electron micrometer to obtain a negative image with a magnification of 280. A photograph with a magnification of 1200 is made by enlarging the negative image. The photograph is examined by an image. analyzing apparatus SPICCA, manufactured by Nihon Avionics Co., Ltd., to measure the domain diameter of the releasing agent. Five hundreds or more domains of the releasing agent are measured to determine the number average of the domains diameter in terms of circle diameter.

The domain diameter of the releasing agent in the toner can be controlled by changing the producing conditions of the toner. The domain diameter of the releasing agent is gradually increased by raising the temperature at the melting and kneading steps in the producing process of the toner within the range of glass transition point Tg to Tg+250° C. of the binder resin. The domain of the releasing agent is not grown when the temperature is less than Tg, and the thermally fixing ability and off-set property tend to degrade by decomposition of the binder resin when the temperature at the melting and kneading steps is higher than Tg+250°. Further, the domain diameter can be changed by controlling the rotation speed of kneading machine or the supplying amount of the raw materials to the producing process.

Well known various kinds of colorant are usable without any limitation as the colorant of the toner particle. Examples of the colorant include carbon black, nigrosine dye, aniline blue, chalcoil blue, chrome yellow, ultramarine blue, du Pont oil red, quinoline yellow, methylene blue chloride, phthalocyanine blue, malachite green oxalate, lamp black and rose bengal. The using amount of the colorant is usually 0.1 to 20 parts by weight per 100 parts by weight of the binder.

As an additive other than the above-mentioned, a charge controlling agent such as a salicylic acid derivative is usable. When preparing a magnetic toner, magnetic particles are added to the toner particles as an additive. As the magnetic particles, that of ferrite or magnetite having a volume average diameter of 0.1 to 2 μm are usable. The adding amount of the magnetic particles is usually 20 to 70 weight-% of the toner particles without the weight of external additive such as the inorganic particles.

Further to the hydrophobic fine silica particles, particles of inorganic substance such as titanium oxide and a complex particles composed of particles of organic compound and fine particles of silica adhered thereon may be externally added to the toner for raising the fluidity of the toner. The inorganic particles are preferably ones hydrophobilized by a treatment with a silane coupling agent or titanium coupling agent.

In the toner composed as above-mentioned, the releasing agent is distributed in the form of domains in the matrix of the toner, and the size of the domain strongly relates to the adhesion of foreign substances on the surface of the photoreceptor and the formation of image defects caused thereby.

In the invention, the number average of the domain diameter is within the range of from 0.1 μm to 1.1 μm. When the average domain diameter is less than 0.1 μm, contamination of image mainly caused by off-set tends to be formed at the time of fixing. On the other hand, when the average domain diameter is more than 1.1 μm, the releasing agent tends to be transferred onto the photoreceptor surface and causes filming of the releasing agent. Foreign substances such as paper powder, dust and metal powder are adhered on the film of the releasing agent, which cause image defects such as spot-defects and line-defects.

In the process using a transferring roller, transfer of the releasing agent on the photoreceptor surface is accelerated by pressure of the transferring roller, and the filming of the releasing agent is considerably formed when the average domain diameter exceeds 1.1 μm and the image defects are caused.

Constitution of transferring roller

In the present invention, the toner image is transferred to the image receiving paper by pressure of the transferring roller which is elastically pressed to the photoreceptor while applying an electric potential bias. As the transferring roller, one composed of a elastic material such as rubber or a porous foamed material is usable. Examples of such the roller include (1) an ion-conductive type roller manufactured by Bridgestone Co., Ltd., (2) an electron-conductive type roller manufactured by Bridgestone Co., Ltd., (3) a Rubycell-type urethane foams roller manufactured by Toyo Polymer Co., Ltd., (4) an ion-conductive type roller manufactured by Sumitomo Rubber Co., Ltd., (5) EPDM type roller manufactured by Sumitomo Rubber Co., Ltd., (6) an epichlorohydrin type roller manufactured by Sumitomo Rubber Co., Ltd., (7) an ENDUR ion-conductive type roller manufactured by INOAC Corp., (8) a foamed silicone type roller manufactured by Tigers Polymer Co., Ltd., (9) a foamed urethane type roller manufactured by Hokushin Kogyo Co., and (10) a foamed silicone type roller manufactured by Shinetsu Polymer Co., Ltd. Among them, porous foamed ones are preferred.

In the image forming method of the invention, it is preferred for attaining good image transfer on the image receiving paper to press the transferring roller to the photoreceptor surface with a pressure of 25 g/cm$^2$ to 1000 g/cm$^2$, more preferably 100 g/cm$^2$ to 800 g/cm$^2$.

When the pressure is lower than 25/cm$^2$, the transferring of toner image becomes insufficient, and when the pressure is higher than 1000 g/cm$^2$, the releasing agent tends to be transferred to the photoreceptor surface and image defects tend to be formed. In such the case, shock caused by applying and releasing of the pressure to the transferring roller is become too large, and image defect caused by slipping the transferred image and a damage on the photoreceptor tend to be caused by the shock.

Further, an impact resilience, electric resistivity and surface hardness are important in the properties required to the transferring roller.

The impact resilience of the transferring roller is preferably 30% to 70%. When the impact resilience is within the above range, the image transfer can be sufficiently carried out and the image defect caused by slipping can be avoided. The impact resilience is determined by the method prescribed in JIS K7311.

The transferring roller preferably has an appropriate electric conductivity. The preferable resistivity of the roller measured by the following method is $1\times10^3\Omega$ to $1\times10^{13}\Omega$.

Method for measuring the electric resistivity of transferring roller

A transferring roller having a diameter of 16 mm, a length of 301 mm and a thickness of elastic layer of 4 mm is prepared. The roller is pressed with a pressure of 170 g/cm$^2$ to an aluminum drum having a diameter of 30 mm. The resistivity between the rotating shaft of the transferring roller and the aluminum drum is measured at 20° C. and a RH of 50%.

It is preferred that the surface of the transferring roller has a hardness measured by Ascar Hardness Meter C of 20 degree to 70 degree. When the hardness of the roller is within the above range, the image transfer can be carried out satisfactorily and image defects caused by slipping is avoided.

Figure 2:
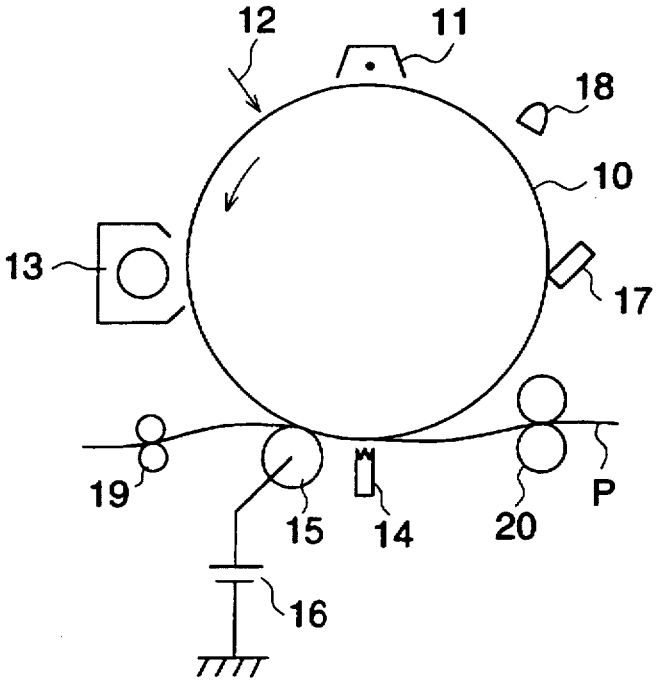
FIGS. 2 and 3 each show a schematic drawing of a image forming apparatus relating to the invention.
Figure 3:
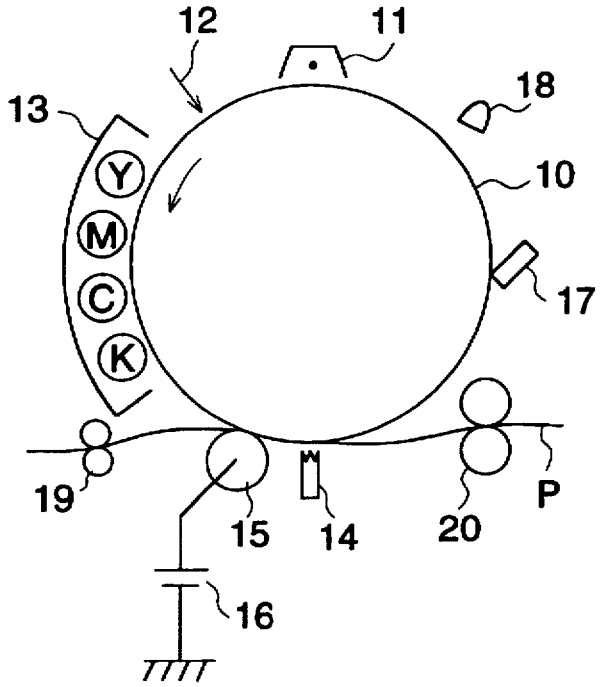

The image forming process of the invention is described according to the figures. FIGS. 2 and 3 are schematic cross-sections of the image forming apparatus usable in the invention.

In FIGS. 2 and 3, photoreceptor drum 10 is an organic photoreceptor drum rotatable in the direction of the arrow. 11 is a charging means for donating uniform charge on the surface of the photoreceptor drum, which may be a corona discharger, a roller charging device or a magnetic brush charging device. 12 is light for an analogue image exposure or light for digital image exposure from a semiconductor laser or a light-emission diode, by which an electrostatic latent image is formed on the photoreceptor. The electrostatic latent image is developed by a contact or non-contact developing method by a developing device 13 which contains a single-component or two-component developer containing fine particles toner with a volume average diameter of 2 to 9 μm, thus a toner image is formed on the photoreceptor drum.

In the single-component or two-component developer, the toner which is prepared so that the domain diameter of the releasing agent contained therein is within the range of 0.1 to 1.1 μm for preventing adhesion of foreign substance and formation of spot-defect and line-defect in the image caused by the foreign substance.

Thus formed toner image is transferred to an image receiving paper P which is transported synchronistically with the rotation of the photoreceptor drum, by a transferring roller 15 pressed to the photoreceptor with a pressure of 25 to 1000 g/cm$^2$, preferably 100 to 800 g/cm$^2$, while applying a direct current bias potential.

A power source 16 of the direct current bias potential to the transferring roller 15 is preferably a constant current power source or a constant voltage power source. The current of the constant current power source is preferably 5 to 15 μA and the voltage of the constant voltage power source is preferably 400 to 1500 V in the absolute value.

The image receiving paper P on which the image is transferred by the transferring roller 15 is separated from the photoreceptor drum 10 by a separating electrode 14 and transported to a fixing device for fixing by heating, the fixing device is not shown in the figure.

The surface of photoreceptor is cleaned by a cleaning blade 17 after the image transfer and discharged by a discharging lamp 18 for standing by the next image formation. 19 and 20 are each upper-stream and lower-stream register rollers, respectively.

FIG. 3 shows a schematic cross-section of an example of color printer, in which a developing apparatus 13 having four developing devices of yellow (Y), magenta (M), cyan (C) and black (K) image development are provided. A yellow, magenta, cyan and black toner images are formed in layers one upon another according to four times of rotation of the photoreceptor drum and the images are collectively transferred onto a image receiving paper and fixed to form a color image.

The transferring roller 15 transfers the color toner images in a form of layers one upon another with a high transfer efficiency and gives a high quality colored image without image deformation.

The method of the invention can be widely applied for an electrophotographic apparatus such as a monochromatic or color copy machine, laser printer, LED printer, liquid crystal shutter printer. The method is further applied for various apparatus using an electrophotographic technology such as an apparatus for recording, plate making and facsimile.

EXAMPLES

<Preparation of Photoreceptor 1>

A coating liquid composed of 1.5 parts by weight of a co-polymer type polyamide resin CM-8000, manufactured by Toray Co., Ltd., dissolved in a mixture of 90 parts by weight of methanol and 10 parts by weight of butanol was coated on an aluminum drum of 80 mm diameter by an immersion method so as to form an interlayer having a thickness of 0.3 μm.

A solution was prepared by dissolving 0.8 parts by weight polybutyral resin Eslex BL-S, manufactured by Sekisui Kagaku Co., Ltd., in a mixture of 80 parts by weight of methyl ethyl ketone and 20 parts by weight of cyclohexanone. To the solution, 14 parts by weight of the compound represented by the following formulas CGM-1 is added as a carrier generating material (CGM) and dispersed to prepare a coating liquid. The coating liquid is coated by an immersion method on the above-mentioned interlayer so as to form a carrier generation layer having a dry thickness of 0.2 μm.

CGM-1: a mixture of the following compounds (1) and (2)

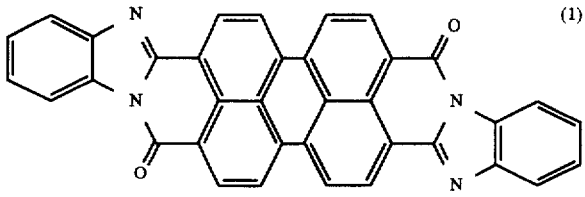

(1)

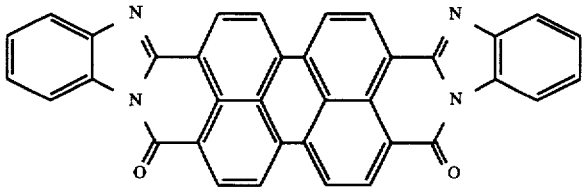

(2)

Next, a coating liquid composed of 15 parts by weight of polycarbonate resin Yupiron Z300, manufactured by Mitsubish Gas Kagaku Co., Ltd., as a binder and 100 parts by weight of the carrier transporting material (CTM) represented by the following formula CTM dissolved in 100 parts by weight of methylene chloride was coated on the carrier generation layer by immersion method so as to form a first carrier transporting layer having a dry thickness of 25 μm.

Then a coating liquid was prepared by dissolving and dispersing 1.5 parts by weight of polycarbonate resin TS-2050 manufactured by Teijin Kasei Co., Ltd. as a binder, 1 part by weight of the CTM represented by the following formula CTM as a carrier transporting material, 0.05 parts by weight of the following anti-oxidation agent and 0.15 parts by weight of Admafine SO-C1 (S-1) manufactured by Admatechs Co., Ltd., in 100 parts by weight of 1,2-dichloroethane. The ratio of S-1 to the binder was 10% by weigh.

The coating liquid was coated on the first carrier transporting layer by a circular coating device capable of regulating the coating amount described in U.S. Pat. No. 5,494,771 and dried for one hour at 110° C. so as to form a second carrier transporting layer having a thickness of 1 μm. Thus Photoreceptor 1 was prepared.

CTM

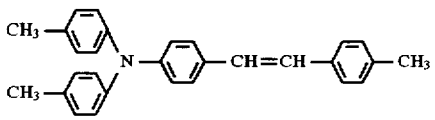

-continued

Anti-oxidation agent

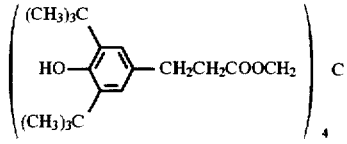

<Preparation of Photoreceptor 2>

Photoreceptor 2 was prepared in the same manner as in Photoreceptor 1 except that the inorganic particles S-1 is replaced by inorganic particles Admafine SO-C2 (S-2) in an amount of 5% by weight of binder.

<Preparation of Photoreceptor 3>

Photoreceptor 3 was prepared in the same manner as in Photoreceptor 1 except that cross-linked polyethylene particles having an average diameter of 1.0 μm, S-3, was added to the second carrier transporting layer in an amount of 7% by weight of binder in place of the inorganic particles S-1.

<Preparation of developer>

Six kinds of two-component developer were prepared. Toners of the developer were prepared under the following conditions in which the kneading condition was changed for each kind of the toner for changing the domain diameter of the releasing agent in the toner particle.

Composition of toner

| | |
|---|---|
| Binder: Styrene-acryl resin (copolymer of styrene/methyl methacrylate/butyl acrylate in a ratio of 75:15:10, MW/Mn = 20) | 100 parts by weight |
| Colorant: Carbon black | 10 parts by weight |
| Releasing agent: Low molecular polypropylene (Mn = 2500) | 3 parts by weight |

Mixing condition

Mixer: Henschel mixer FM-10B manufactured by Mitui-miike Kakouki Co., Ltd.

Circumference speed of blade: 40 m/sec.

Mixing time: 3 minutes

Kneading condition

Kneader: PCM-30 manufactured by Ikegai Tekkou Co., Ltd.

Kneading condition: See Table 1

TABLE 1

| | Kneading condition | | | Domain |
|---|---|---|---|---|
| Toner No. | Set temperature in kneading zone | Rotating speed of kneader | Supplying amount of raw materials | diameter of releasing agent |
| 1 | 85° C. | 150 rpm | 120 g/min. | 0.07 μm |
| 2 | 95° C. | 150 rpm | 120 g/min. | 0.15 μm |
| 3 | 120° C. | 150 rpm | 120 g/min. | 0.31 μm |
| 4 | 170° C. | 150 rpm | 110 g/min. | 0.72 μm |
| 5 | 200° C. | 150 rpm | 100 g/min. | 1.05 μm |
| 6 | 220° C. | 150 rpm | 80 g/min. | 1.21 μm |

Crushing condition

Crusher: A jet type crusher IDS-3 manufactured by Nihon Neumatic Co., Ltd.,

Crushing pressure: 5 kg/cm$^2$

Classifying condition

Classifying machine: Microflex 132MP manufactured by Alpine Co., Ltd.

Six kinds of toner particles each having a volume average particle diameter of 8.5 μm were prepared by the mixing, melting, kneading, crushing and classifying treatments under the above-above-mentioned conditions. The number average domain diameter of the releasing agent in each kind of the toner particle is changed as shown in Table 1. Hydrophobilized silica Aerogil R-972, manufactured by Nihon Aerogil Co., Ltd., was externally added to each kind of the toner particles. Thus Toner Nos. 1 to 6 were prepared.

Six kinds of two-component developers were each prepared by mixing 4 parts by weight of the above obtained toner particles and 95 parts by weight of carrier composed of ferrite particles having a volume average diameter of 80 μm coated with a fluorinated resin layer composed of a coplymer of 2,2,2-trifluoroethyl methacrylate and styrene.

The above-prepared photoreceptors, developers and the following Transferring rollers 1 and 2 were installed in the combinations shown in Table 2 in a modified reversal digital copying machine Konica 7050, manufactured by Konica Corp., and 10,000 sheets of copies were prepared by each of the combination to evaluation of the copy image.

Transferring roller No. 1: Ion-conductive type roller manufactured by Sumitomo Rubber Ind. Co., Ltd., Ascar C hardness: 36, Electric resistivity: $7.5\times10^{7}\Omega$, Average foam diameter (isolated foam): 80 μm Transferring roller No. 2: Carbon black containing Ruby-cell (foamed polyurethane type) roller manufactured by Nitto Kogyo Co., Ltd., Ascar C hardness: 30, Electric resistivity: $2\times10^{8}$ Ω, Average foam diameter (continuous foam): 20 μm The potential applied to Transferring rollers 1 and 2 was −1 kV.

Method of image quality evaluation

An original image with a size of 257 mm×364 mm including a solid black image, medium density image, white background portion and a resolving power chart, in which the area of the image occupies 10% of the whole area of the original, was repeatedly copied by the above-mentioned copy machine. The image density, defect and resolving power of the image formed on the 10,000th copy were evaluated and ranked according to the following norms.

Image defect

A: Number of black spot in the copied image with the size of 257 mm×364 mm is 3 or less.

B: Number of black spot in the copied image with the size of 257 mm×364 mm is 4 or more.

Image density

A: Reflective density of the solid black image measured by Sakura Densitometer PDA65, manufactured by Konica Corp., is 1.2 or more.

B: Reflective density measured by the same manner as above is less than 1.2.

A: A line image of 8 lines/mm is resolved.

B: A line image of 8 lines/mm is not resolved.

Results of the evaluation are listed in Table 2.

TABLE 2

| | Photoreceptor | | | Transferring roller | | Developer | | Image quality | | |
|---|---|---|---|---|---|---|---|---|---|---|
| Test No. | No. | Surface roughness Rz (μm) | Fine particle, Kind, average diameter & Amount (wt-%) | No. | Pressure (g/cm²) | No. | Domain diameter of releasing agent (μm) | Image defect | Image density | Resolving power |
| Ex. 1 | 1 | 0.3 | S-1 (0.2 μm) 10 | 1 | 300 | 2 | 0.15 | A | A | A |
| Ex. 2 | 1 | 0.3 | S-1 (0.2 μm) 10 | 1 | 500 | 3 | 0.31 | A | A | A |
| Ex. 3 | 1 | 0.3 | S-1 (0.2 μm) 10 | 1 | 30 | 4 | 0.72 | A | A | A |
| Ex. 4 | 2 | 0.4 | S-2 (0.5 μm) 5 | 1 | 900 | 5 | 1.05 | A | A | A |
| Ex. 5 | 1 | 0.3 | S-1 (0.2 μm) 10 | 2 | 300 | 4 | 0.72 | A | A | A |
| Ex. 6 | 3 | 0.5 | S-3 (1.0 μm) 7 | 1 | 300 | 2 | 0.15 | A | A | A |
| C. 1 | 1 | 0.3 | S-1 (0.2 μm) 10 | 1 | 20 | 4 | 0.72 | A | B | B |
| C. 2 | 1 | 0.3 | S-1 (0.2 μm) 10 | 1 | 1100 | 4 | 0.72 | B | A | B |
| C. 3 | 1 | 0.3 | S-1 (0.2 μm) 10 | 1 | 500 | 1 | 0.07 | A | B | B |
| C. 4 | 1 | 0.3 | S-1 (0.2 μm) 10 | 1 | 500 | 6 | 1.21 | B | A | B |

In table Ex. and C. are each Example of the invention and Comparative Example, respectively. As is shown in Table 2, Examples 1 to 5 of the invention give excellent results in the all properties evaluated. Contrary to that, in Comparative examples 1 to 4 falling without the invention, a problem is found in at least one of the evaluated properties.

What is claimed is:

1. A method for forming plural images by repeating a process comprising the steps of forming an electrostatic latent image on an organic photoreceptor, the outermost layer of said photoreceptor contains inorganic or organic particles having a volume average diameter of 0.05 μm to 2.0 μm, and the surface of the outermost layer having a ten point height of irregularities Rz of 0.05 μm to 1.0 μm, developing said electrostatic latent image formed on said organic photoreceptor with a toner particles each of which contains domains of releasing agent having a number average domain diameter of 0.1 μm to 1.1 μm to form a toner image, transferring said toner image to an image receiving paper by a transferring roller being pressed to said organic photoreceptor with a pressure of 25 g/cm$^2$ to 1000 g/cm$^2$, said transferring roller has an impact resilience of 30% to 70%, and the surface of said transferring roller comprises a porous foamed material, separating said image receiving paper carrying said transferred toner image from said photoreceptor, fixing said toner image carried on said image receiving paper, and cleaning the surface of said photoreceptor.

2. The method of claim 1, wherein said inorganic particle is composed of cerium oxide, chromium oxide, aluminum oxide, magnesium oxide, silicon oxide, tin oxide, zirconium oxide, iron oxide, titanium oxide, calcium sulfate, barium sulfate, calcium silicate, magnesium silicate, boron nitride, titanium nitride, silicon carbide, titanium carbide, tungsten carbide, zirconium carbide, zirconium boride or titanium boride.

3. The method of claim 1, wherein said organic particle is composed of Teflon, polypropylene, cross-linked polystyrene, polyethylene or cross-linked polymethyl methacrylate.

4. The method of claim 1, wherein said releasing agent is a polyolefin wax, a resin acid ester wax, a higher fatty acid wax, higher alcohol wax, a paraffin wax or an acid amide wax.

5. The method of claim 4, wherein said releasing agent has a softening point of 100° C. to 160° C.

6. The method of claim 4, wherein releasing agent is polypropylene or polyethylene each having a number average molecular weight of 2,000 to 8,000.

7. The method of claim 1, wherein said organic photoreceptor comprises plural carrier transporting layers and a carrier generating layer provided on a support, and one of said plural carrier transporting layers is arranged at the outermost portion of said photoreceptor.

8. The method of claim 1, wherein said toner has a volume average diameter of 3 to 9 μm.

9. The method of claim 1, wherein said transferring roller has electric conductivity of $1\times10^3\Omega$ to $1\times10^{13}\Omega$.

10. The method of claim 1, wherein said transferring roller is pressed with a pressure of 100 to 800 g/cm$^2$.

11. A method for forming plural images by repeating a process comprising the steps of forming an electrostatic latent image on an organic photoreceptor, the outermost layer of said photoreceptor contains inorganic or organic particles having a volume average diameter of 0.05 μm to 2.0 μm, and the surface of the outermost layer having a ten point height of irregularities Rz of 0.05 μm to 1.0 μm, developing said electrostatic latent image formed on said organic photoreceptor having an outermost layer with a toner particles each of which contains domains of a polypropylene or a polyethylene each having a number average molecular weight of 2,000 to 8,000 as a releasing agent, said domain has a number average diameter of 0.1 μm, to form a toner image, transferring said toner image to a image receiving paper by a transferring roller being pressed to said organic photoreceptor with a pressure of 25 g/cm$^2$ to 1000 g/cm$^2$, said transferring roller has an impact resilience of 30% to 70%, and the surface of said transferring roller comprises a porous foamed material, separating said image receiving paper carrying said transferred toner image from said photoreceptor, fixing said toner image carried on said image receiving paper, and cleaning the surface of said photoreceptor.

* * * * *